US010598434B2

(12) United States Patent
Tokman et al.

(10) Patent No.: US 10,598,434 B2
(45) Date of Patent: Mar. 24, 2020

(54) MULTI-STAGE CEMENT CALCINING PLANT SUSPENSION PREHEATER

(71) Applicant: FLSmidth A/S, Valby (DK)

(72) Inventors: Alexander Flavio Tokman, Korsør (DK); Gilla Pommer, Ringsted (DK); Per Ingemann Petersen, Holbaek (DK)

(73) Assignee: FLSmidth A/S (DK)

( * ) Notice: Subject to any disclaimer, the term of this patent is extended or adjusted under 35 U.S.C. 154(b) by 246 days.

(21) Appl. No.: 15/753,049

(22) PCT Filed: Oct. 6, 2016

(86) PCT No.: PCT/EP2016/073906
§ 371 (c)(1),
(2) Date: Feb. 15, 2018

(87) PCT Pub. No.: WO2017/060369
PCT Pub. Date: Apr. 13, 2017

(65) Prior Publication Data

US 2019/0003770 A1 Jan. 3, 2019

(30) Foreign Application Priority Data

Oct. 8, 2015 (DK) ..... 2015 70633
Feb. 24, 2016 (DK) ..... 2016 70099

(51) Int. Cl.
*F27B 7/20* (2006.01)
*F27D 17/00* (2006.01)
*F27B 15/00* (2006.01)

(52) U.S. Cl.
CPC ..... *F27B 7/2033* (2013.01); *F27B 7/2016* (2013.01); *F27B 15/003* (2013.01); *F27D 17/004* (2013.01); *F27D 2017/009* (2013.01)

(58) Field of Classification Search
CPC ..... F27B 7/2033
See application file for complete search history.

(56) References Cited

U.S. PATENT DOCUMENTS 2,757,921 A * 8/1956 Petersen ..... C22B 1/10 432/16
3,305,940 A 2/1967 Isler
3,593,929 A 7/1971 Hughes
4,326,845 A 4/1982 Hess
5,131,462 A 7/1992 Andreasen
(Continued)

FOREIGN PATENT DOCUMENTS

BE 698006 A 10/1967
CH 457731 A 6/1968
JP S60161762 A 8/1985

OTHER PUBLICATIONS

The International Search Report and Written Opinion dated May 12, 2016, 14 pages.

*Primary Examiner* — Nathaniel Herzfeld
(74) *Attorney, Agent, or Firm* — Jeffrey A. Sharp

(57) ABSTRACT

The invention relates to multi-stage cement calcining plant suspension preheater of the kind mentioned in the introduction, wherein the preheater comprises a top separator comprising a central tube entering the top separator in a lowermost part of the separator housing whereas the central tubes of the bottom separators enters the separator housing in an upper part of the separator housing.

20 Claims, 12 Drawing Sheets

(56) References Cited

U.S. PATENT DOCUMENTS

| | | | | |
|---|---|---|---|---|
| 5,165,549 | A * | 11/1992 | Kanda | B07B 7/086 209/135 |
| 6,012,908 | A * | 1/2000 | Tanaka | F04B 39/0055 417/312 |
| 6,269,955 | B1 * | 8/2001 | Morimoto | B07B 7/08 209/139.1 |
| 8,163,082 | B2 * | 4/2012 | Hansen | C04B 7/365 106/739 |
| 2005/0100503 | A1 * | 5/2005 | Feng | C01B 17/506 423/542 |

* cited by examiner

MULTI-STAGE CEMENT CALCINING PLANT SUSPENSION PREHEATER

FIELD OF THE INVENTION

The present invention relates to a multi-stage cement calcining plant suspension preheater for preheating the cement raw meal prior to its being burned in a kiln into cement clinker which is subsequently cooled in a clinker cooler. The preheater comprises a top separator comprising a central tube entering the top separator in a lowermost part of the separator housing whereas the central tubes of the bottom separators enters the separator housing in an upper part of the separator housing. Also the invention relates to a method of installing a top separator of the aforementioned kind. Also the invention relates to a top separator comprising a material feed inlet arranged in a central part of the upper part of the top separator housing.

BACKGROUND ART

In the cement industry it is customary practice to use a so-called cyclone preheater for preheating the cement raw meal prior to its being burned in a kiln into cement clinker which is subsequently cooled in a clinker cooler. Typically, a cyclone preheater comprising four to six cyclone stages is used arranged in a preheater tower construction. The raw meal is introduced in the first cyclone stage and heated by direct contact with hot exhaust gases from the kiln according to the counter flow principle. Preheaters of this kind are generally known from the patent literature and one example is provided in EP 0 455 301.

A well-known limitation of the capacity of such preheater towers is the building costs of such towers easily exceeding 100 meters nowadays. Consequently civil construction costs are very high for these preheater towers. One aspect especially makes the construction costs very high for these towers namely that they are dimensioned after the weight of the all cyclones including the material present in the cyclones. During operation the weight of material in the separator cyclone stages are not very high, since the raw meal is suspended in an air stream. However, if the outlet of the cyclones for some reason clog up the cyclones will gradually fill up the entire inner space of the cyclones until the inlet of the cyclone is also clogged. A cyclone stage completely filled with compacted raw mill adds several tons to the empty weight of the cyclone and thereby to the preheater tower construction. When dimensioning a preheater tower, the construction must typically be dimensioned according to worst case scenarios. Typically the maximum filling level of the cyclones is a critical parameter. All preheater towers are dimensioned to accommodate even critical situations when filling levels become close to the worst case scenario e.g. due to clogging.

Therefore it would be advantageous to be able to construct a preheater tower and preheater system with the ability to minimize the worst case scenario weight of the cyclones filled to their maximum filling level such that capacity may be increased without burdening the construction costs severely in these tall constructions.

Another aspect also that makes it necessary to build these very high towers is the need for high production rates with high temperature differences. Maintaining high production rates at high temperature differences require optimal heat exchange between air and raw meal material.

Therefore it would also be advantageous to be able to construct a preheater tower and preheater system with the ability to improve heat exchange compared to the prior art to decrease height of these towers or maximize production rates at the same height or even allow for less preheater stages to be used by using less separators in the towers.

SUMMARY OF THE INVENTION

It is an object of the present invention to wholly or partly overcome the above disadvantages and drawbacks of the prior art. More specifically, it is an object to provide an improved multi-stage cement calcining plant suspension preheater of the kind mentioned in the introduction, wherein the preheater comprises a top separator comprising a central tube entering the top separator in a lowermost part of the separator housing whereas the central tubes of the bottom separators enters the separator housing in an upper part of the separator housing. Also it is an object of the present invention to provide a method comprising the steps of removing an old uppermost separator having a first housing diameter in an existing multi-stage cement calcining plant and installing a new uppermost separator having a second housing diameter being larger than the first housing diameter of the old uppermost separator.

Another object of the present invention is to provide an improved multi-stage cement calcining plant suspension preheater of the kind mentioned in the introduction, wherein the preheater comprises a top separator comprising a central tube entering the top separator in a lowermost part of the separator housing whereas the central tubes of the bottom separators enters the separator housing in an upper part of the separator housing, and wherein the top separator comprises a material feed inlet arranged in a central part of the upper part of the top separator housing.

The above objects, together with numerous other objects, advantages, and features, which will become evident from the below description, are accomplished by a solution in accordance with the present invention by a preheater comprises a plurality of stages each of which has a separator for separating raw cement meal from a gas in which the meal is suspended and wherein the separators of said plurality of stages are serially connected and in series with a calcining combustor.

Further the plurality of stages comprises a top separator arranged at the uppermost stage of the preheater and a plurality of bottom separators arranged at the lowermost stages of the preheater, where the separators comprise a separator housing comprising a substantially cylindrical upper part and a substantially conical lower part, a tangential inlet in the upper part of the separator housing for introducing an un-separated stream of gas and raw cement meal in suspension, an outlet in a lowermost end of the conical part for discharging a first fraction of coarse cement raw meal material, a central tube extending with a free end axially into the separator housing for diverting a second fraction of fine cement raw meal material and gas, and where the central tube of the top separator enters the separator housing in the lower part of the separator housing, whereas the central tubes of the bottom separators enters the separator housing in the upper part of the separator housing, and further wherein the top separator comprises a top separator suspension having a receiving opening for receiving and supporting the top separator and wherein a receiving opening diameter of the receiving opening is smaller than a top separator upper part diameter of the upper part of the top separator housing and wherein the top separator is suspended by the top separator suspension engaging the lower part of the top separator housing.

In one embodiment of the invention, a ratio between an upper part diameter $D_{CYL}$ of the substantially cylindrical upper part of the separator housing and a top separator central tube diameter $D_{CT}$ is between $1.8<D_{CYL}/D_{CT}<3$ or more preferably $2.1<D_{CYL}/D_{CT}<2.8$ or even more preferably $2.3<D_{CYL}/D_{CT}<2.6$.

With these parameters of the central tube diameter $D_{CT}$ and cylindrical upper part diameter $D_{CYL}$ it is possible to obtain a fractional separation efficiency in a range between 91% to 95% which is the preferred range. The resulting pressure drop through the separator typically lies in a range between 5-20 mBar.

In another embodiment of the invention, the top separator upper part diameter of the upper part of the top separator housing is larger than a bottom separator upper part diameter of the upper part of the bottom separator housings of the bottom separators.

In a method of constructing a multi-stage cement calcining plant suspension preheater according to the invention an old uppermost top separator having a first housing diameter is removed from an existing multi-stage cement calcining plant and a new uppermost separator having a second housing diameter being larger than the first housing diameter of the old uppermost separator is arranged in a support frame of the old uppermost separator.

The above objects, together with numerous other objects, advantages, and features, which will become evident from the below description, are also accomplished by a solution in accordance with the present invention by a preheater comprising a plurality of stages each of which has a separator for separating raw cement meal from a gas in which the meal is suspended and wherein said separators of said plurality of stages are serially connected and in series with a calcining combustor, and where said plurality of stages comprise a top separator arranged at the uppermost stage of the preheater and a plurality of bottom separators arranged at the lowermost stages of the preheater, furthermore the bottom separators comprise a separator housing comprising a substantially cylindrical upper part and a substantially conical lower part, a tangential inlet in the upper part of the separator housing for introducing an un-separated stream of gas and raw cement meal in suspension, an outlet in a lowermost end of the conical part for discharging a first fraction of coarse cement raw meal material, a central tube extending with a free end axially into the separator housing for diverting a second fraction of fine cement raw meal material and gas, a top separator central tube of the top separator entering the separator housing in the lower part of the top separator housing, and a plurality of bottom separator central tubes of the bottom separators entering the bottom separator housings in the upper part of the separator housing, and further wherein the top separator comprises a material feed inlet arranged in a central part of the upper part of the top separator housing.

In one embodiment of the invention, the preheater comprises a second top separator arranged at the second uppermost stage of the preheater comprising a top separator central tube of the second top separator entering the separator housing in the lower part of the top separator housing.

In order to increase the capacity of the preheater the second uppermost stage may also be configured as a top separator to benefit from the centrally arranged material feed inlet.

In another embodiment of the invention, the preheater comprises one or more additional top separators comprising top separator central tubes entering the separator housings in the lower part of the top separator housing in one or more of the lowermost stages.

In certain configurations of the preheater a second stage of the preheater may also benefit from having a centrally arranged material feed inlet. A top cyclone and a second cyclone with centrally arranged material feed inlets may reduce the number of cyclones from e.g. 5 to 3 or even by introducing more cyclones with centrally arranged material feed inlets in very large preheater configurations reduce the number of cyclones from e.g. 8 to 5 while still maintaining the same production rate as the eight-cyclone configuration using prior art cyclone designs.

In another embodiment of the invention, the material feed inlet arranged in the central part of the upper part of the one or more top separators are arranged co-axially with a longitudinal centre axis of the housing of the one or more top separators.

By arranging the material feed inlet in the central part of the upper part of the one or more top separators co-axially with a longitudinal centre axis of the housing, the material inlet may provide several benefits to the system. The central position ensures the crossflow path of the material from the central position towards the periphery crossing the air path from the periphery towards the centrally arranged outlet, but further the arrangement of the inlet co-axially with the longitudinal axis of the housing allows the inlet to function as a vortex finder ensuring the best possible vortex flow conditions in the cyclone.

In another embodiment of the invention, at least the material feed inlet of one or more of the top separators comprises means for spreading the material feed in a tangential direction of the housing of the top separator directing the material feed in a direction from the centrally arranged inlet towards the periphery of the housing of the top separator such that the material exiting the material inlet has a tangential velocity component in a tangential direction of the top separator housing.

In this embodiment the material inlet of one or more of the top separators has been provided with means for actively spreading the material upon entry in the cyclone. Since the air stream in the cyclones is rotating around the longitudinal axis the air stream itself will upon mixing with the material transport the material towards the periphery from the centrally arranged inlet due to centrifugal forces. However, to increase the tangential velocity of the material entering the cyclone in the tangential direction from the inlet means for spreading the material feed in a tangential direction of the housing of the top separator from the centrally arranged inlet towards the periphery in the tangential direction is advantageously introduced to maximize the crossflow heat exchange.

In another embodiment of the invention, the means for spreading the material feed in a tangential direction of the housing of the top separator directing the material feed in a direction from the centrally arranged inlet towards the periphery of the housing of the top separator such that the material exiting the material inlet has a tangential velocity component in a tangential direction of the top separator housing, wherein the tangential direction is co-current with the direction of airflow in the top separator.

In another embodiment of the invention, at least the material feed inlet of one or more of the top separators comprises means for spreading the material feed in a radial direction of the housing of the top separator directing the material feed in a direction from the centrally arranged inlet towards the periphery of the housing of the top separator such that the material exiting the material inlet has a radial velocity component in a radial direction of the top separator housing.

Also increasing the velocity of the material feed but further in the radial direction means for spreading the material feed in a radial direction may also be introduced to increase the radial velocity component of the material feed to achieve a velocity of the material feed optimized to compliment the airstream of the cyclone to have the best possible cross-flow heat exchange properties.

In another embodiment of the invention, the means for spreading the material feed in a radial and/or tangential direction comprises an exit tube directed in a radial and/or tangential direction.

A cheap solution with low maintenance of the means for spreading the material feed in a radial and/or tangential direction is directing the material feed through a tube in a specific or adjustable direction to ensure the exiting material has a certain tangential and/or radial velocity component.

In another embodiment of the invention, the means for spreading the material feed in a radial and/or tangential direction comprises a splash plate angled in a radial and/or tangential direction.

To facilitate for instance an adjustable solution the material stream in the inlet may be directed through a tube and then diverged by a splash plate in the correct angle. The splash plate may be adjustable for fine tuning of the flow path of the material or for operation under various operation modes, different airstream volumes, different materials, different material size compositions etc. The splash plate may also be advantageous to allow the means for spreading the material feed to be centrally arranged with a limited extension in the radial direction.

In another embodiment of the invention, the means for spreading the material feed in a radial and/or tangential direction comprises material accelerating means such as pressurized air or mechanical conveyor means.

The speed of the material particles may be further increased by adding pressurized air to the stream of material entering through the inlet or by accelerating the material stream by other means of conveying to ensure that the speed of the material complements the airstream properties to maximize heat exchange.

In another embodiment of the invention, the means for spreading the material feed in a radial and/or tangential direction comprises a rotating plate for accelerating the material after entry into the separator.

It may be advantageous to avoid additional airstreams entering the cyclones with cold or preheated air, since false air is typically lowering efficiency of the cyclone and an embodiment of the means for spreading the material inside the cyclone not necessitating pressurized air or other external means for accelerating the material is to introduce a rotating plate inside cyclone at the material inlet and then spill the material feed on the rotating plate and control the radial and tangential velocity components by the rotational speed of the rotating plate. The rotating plate is advantageously arranged inside the cyclone on a rotation axle entering the cyclone in the longitudinal direction.

In another embodiment of the invention, the rotating plate of the means for spreading the material feed comprises one or more substantially vertical shovel blades for forcing the material in the direction of rotation of the rotating plate.

To improve the gripping effect of the material on the rotating plate, the rotating plate preferably comprises one or more shovel blades. The shovel blades allow the material stream to be more quickly accelerated by ensuring that the material stream archives the same rotational speed as the rotating plate. Most advantageously, the shovel blades allows the rotating plate to significantly increase the tangential component of the material feed since the shovel blade will force the material in the tangential direction when exiting the rotating plate.

In another embodiment of the invention, the shovel blades of the rotating plate extend from the centre of the rotating plate to the periphery of the rotating plate in a substantial radial direction.

The most optimal direction of the shovel blades is in the radial direction where the material feed receives a primarily tangential accelerating force from the shovel blades at the exit point where the material feed exits the rotating plate.

In another embodiment of the invention, the shovel blades of the rotating plate are gradually decreasing in height from the centre of the rotating plate towards the periphery of the rotating plate.

When using rotation plates the material feed is typically done centrally around the rotation axle of the rotating plate. Therefore it may be advantageous to increase the height of the shovel blades at least near the centre to begin accelerating the material stream as soon as possible in its way towards the rotating plate, however, to still have a rotating plate of the lowest possible weight and dimension the height is optimally decreasing in height towards the periphery since the material stream near the periphery will be following the rotating plate rather than still be flowing freely downwards through the air.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figures 1, 2:
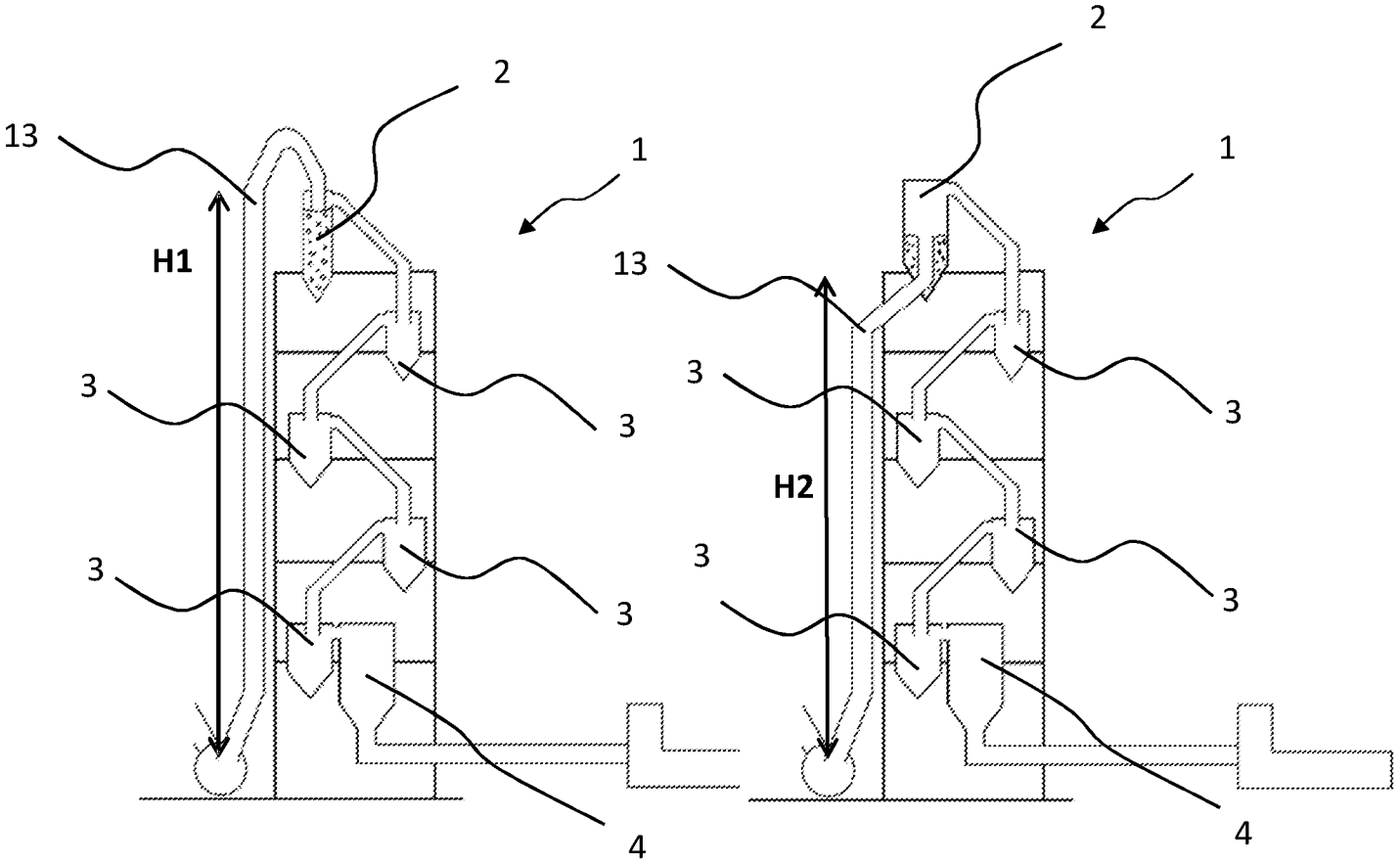
Fig. 1 (Prior art)
FIG. 1 shows a cross-sectional view of a multi-stage cement calcining plant suspension preheater of the prior art.
FIG. 2 shows a cross-sectional view of a multi-stage cement calcining plant suspension preheater of the invention.
Figure 3:
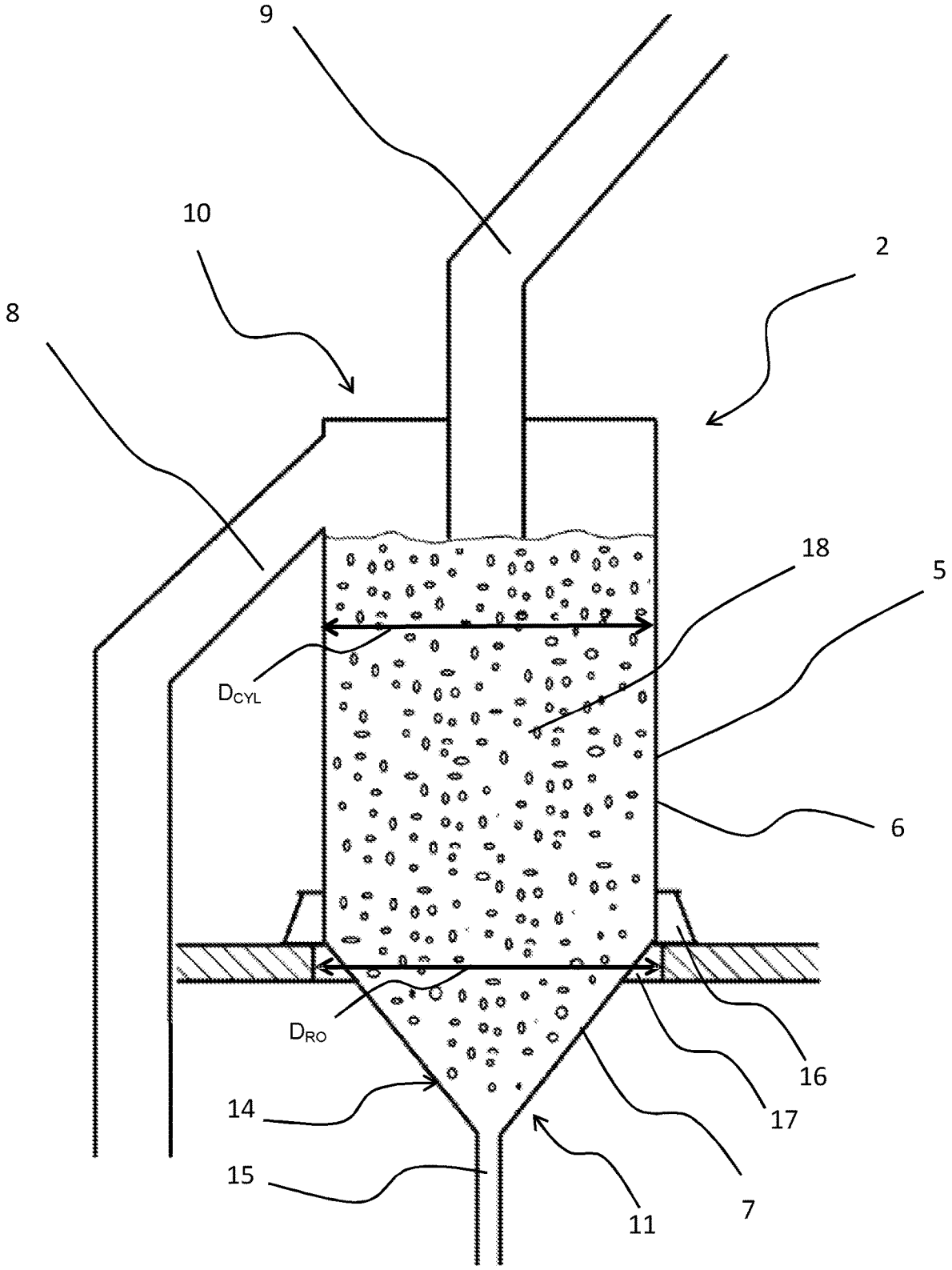
Fig. 3 (Prior art)
FIG. 3 shows a magnified view of a top separator of a multi-stage cement calcining plant suspension preheater of the prior art.
Figure 4:
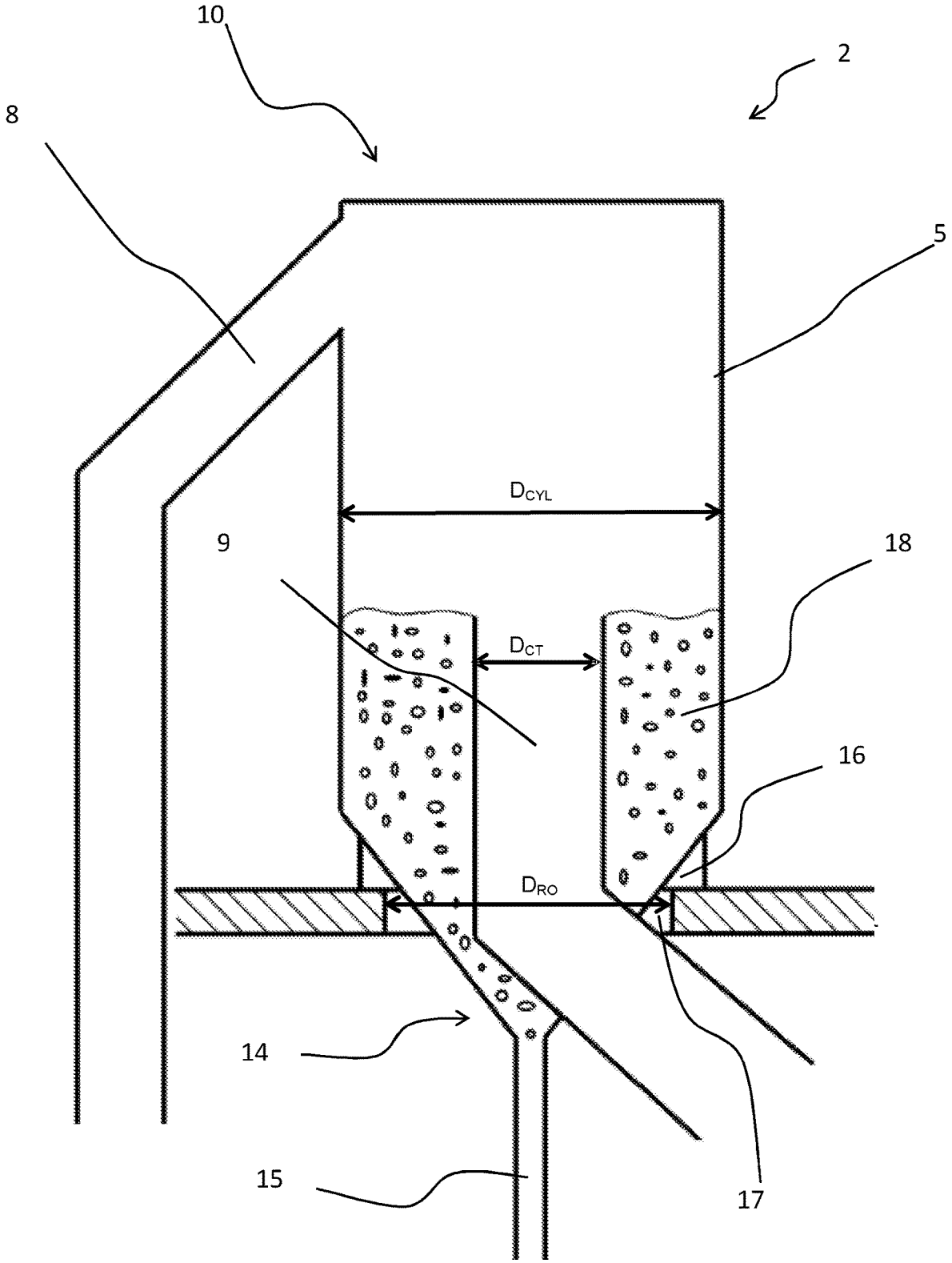
FIG. 4 shows a magnified view of a top separator of a multi-stage cement calcining plant suspension preheater of the invention.

FIG. 1 shows a cross-sectional view of a multi-stage cement calcining plant suspension preheater 1 of the prior art comprising a plurality of stages each of which has a separator for separating raw cement meal from a gas in which the meal is suspended and wherein said separators of said plurality of stages are serially connected and in series with a calcining combustor 4, where the plurality of stages comprises a top separator 2 arranged at the uppermost stage of the preheater and a plurality of bottom separators 3 arranged at the lowermost stages of the preheater. FIG. 2 shows a cross-sectional view of a multi-stage cement calcining plant suspension preheater of the invention also comprising a plurality of stages each of which has a separator for separating raw cement meal from a gas in which the meal is suspended and wherein said separators of said plurality of stages are serially connected and in series with a calcining combustor 4, where the plurality of stages comprises a top separator 2 arranged at the uppermost stage of the preheater and a plurality of bottom separators 3 arranged at the lowermost stages of the preheater. As becomes evident from the difference between the prior art preheater shown in FIG. 1 and the preheater of the invention shown in FIG. 2, the height H1 of the tubing 13 leading to the top separator 2 of the prior art is much higher than the height H2 of the tubing 13 leading to the top separator 2 of the invention and thus construction costs are significantly limited. FIG. 3 is a magnified view of the top separator of the preheater of the prior art as shown in FIG. 1. As seen in FIG. 3 the top separator of the preheater of the prior art comprises a central tube 9 of the top separator which enters the separator housing in the upper part 10 of the separator housing 5, like the central tubes of the bottom separators enters the separator housing in the upper part of the separator housing as shown in FIG. 1. The separators 2, 3 comprise a separator housing 5 comprising a substantially cylindrical upper part 6 and a substantially conical lower part 7, a tangential inlet 8 in an upper part 10 of the separator housing 5 for introducing an un-separated stream of gas and raw cement meal in suspension. Further the top separator of the prior art comprises an outlet 15 in a lowermost end 14 of the conical part 7 for discharging a first fraction of coarse cement raw meal material, and a central tube 9 extending with a free end axially into the separator housing 5 for diverting a second fraction of fine cement raw meal material and gas. The central tube 9 of the top separator 2 enters the separator housing in the upper part 10 of the separator housing 5. Furthermore, the top separator 2 comprises a top separator suspension having a receiving opening 17 for receiving and supporting the top separator 2. As seen by the hatched area the top separator of the prior art has a worst case scenario filling 18 extending up till the tangential inlet 8. If the outlet 15 is clogged during operation the top separator may be filled until the raw meal finally can escape the separator through the central tube 9. The weight of a completely filled separator with this degree of filling is very substantial and the civil construction must be dimensioned to be able to accommodate this weight. FIG. 4 shows a magnified view of the top separator according to the invention where the central tube 9 enters the separator housing 5 through a lower part 7 of the separator housing 5 and not through the upper part 10 as opposed to the prior art solution as seen in FIG. 1. It is essential that the central tube 9 does not enter the separator housing 5 through the upper part 10 in order to achieve the invention. The invention has several advantages over the prior art, the main advantage being the lowered worst case scenario degree of filling of the top separator 2 which allows a decrease in the costs of constructing the civil building. Since the raw meal would be able to escape the separator through the central tube 9 if the outlet 15 is clogged, the weight of the completely filled top separator 2 would be much lower in a preheater according to the invention. Furthermore this has the advantage that old top separators could be interchanged in existing preheaters with larger top separators without enforcing the civil construction further. The construction has been dimensioned according to the old type of top separators and the new type will have a lower worst case scenario filling weight, thus it is possible to install a larger separator using the existing construction. As seen in FIG. 4 even the existing suspension of the old top separator may be re-used since the new top separator having a larger diameter $D_{cyl}$ of the cylindrical part 6 may be supported in the existing suspension 16, since the separator may be supported on the conical part 7 of the separator.

Preferably the ratio between an upper part diameter $D_{CYL}$ of the substantially cylindrical upper part 6 of the separator housing 5 and a top separator central tube diameter $D_{CT}$ is between $1.8<D_{CYL}/D_{CT}<3$ or more preferably $2.1<D_{CYL}/D_{CT}<2.8$ or even more preferably $2.3<D_{CYL}/D_{CT}<2.6$.

The relation between the central tube diameter $D_{CT}$ and cylindrical upper part diameter $D_{CYL}$ makes it possible to obtain a fractional separation efficiency in a range between 91% to 95% which is the preferred range when the resulting pressure drop through the separator typically lies in a range between 5-20 mBar. The top separator upper part diameter of the cylindrical upper part of the top separator housing is larger than a bottom separator upper part diameter of the upper part of the bottom separator housings of the bottom separators.

As seen in FIG. 4 a new top separator may be fitted into an existing receiving opening 17 of the suspension 16 by supporting the housing on the conical part of the housing and thereby a new separator having a larger diameter $D_{CYL}$ of the cylindrical part 6 in the new top separator 2 than in the old top separator 2 without changing the suspension design of the suspension 16 or the diameter $D_{RO}$ of the receiving opening 17.

Figure 5:
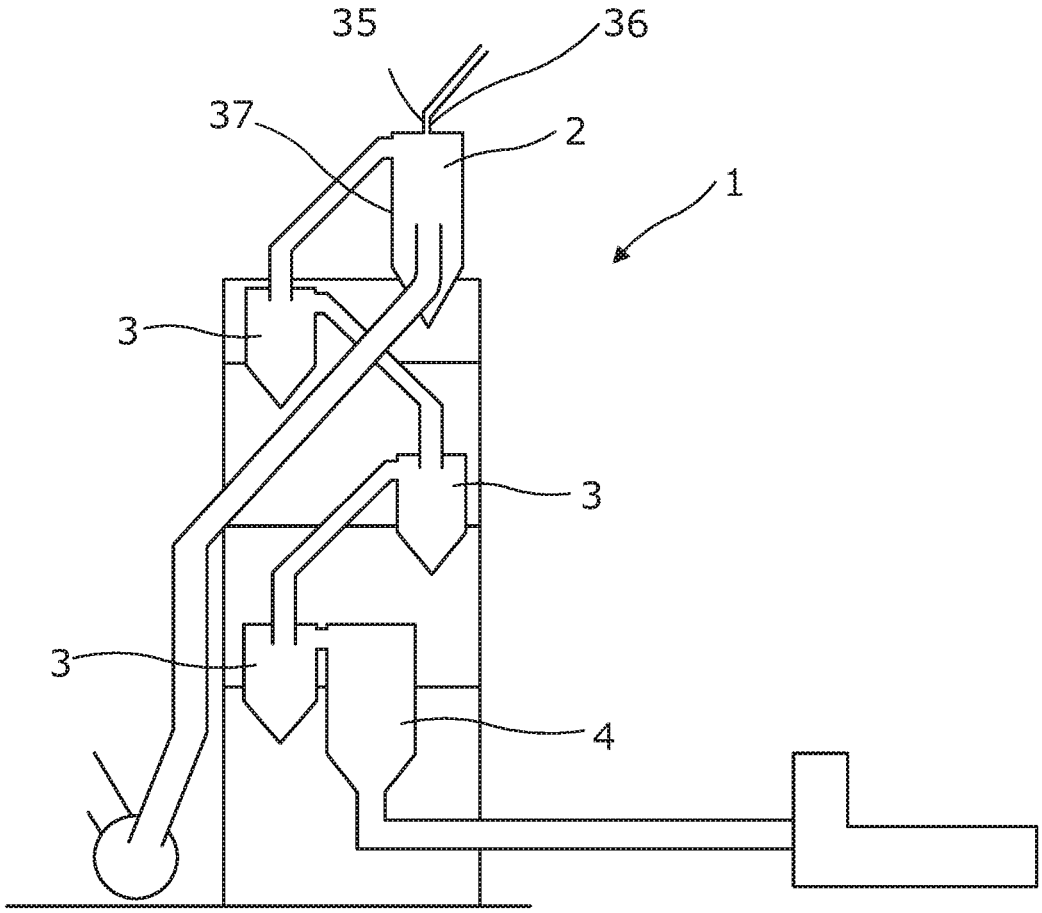
FIG. 5 shows a cross-sectional view of a multi-stage cement calcining plant suspension preheater of the invention.

FIG. 5 shows a cross-sectional view of a multi-stage cement calcining plant suspension preheater 1 of the invention comprising a plurality of stages each of which has a separator for separating raw cement meal from a gas in which the meal is suspended and wherein said separators of said plurality of stages are serially connected and in series with a calcining combustor 4, where the plurality of stages comprises a top separator 2 arranged at the uppermost stage of the preheater and a plurality of bottom separators 3 arranged at the lowermost stages of the preheater wherein the top separator 2 comprises a material feed inlet 35 arranged in a central part 36 of the upper part of the top separator housing 10.

Figure 6A:
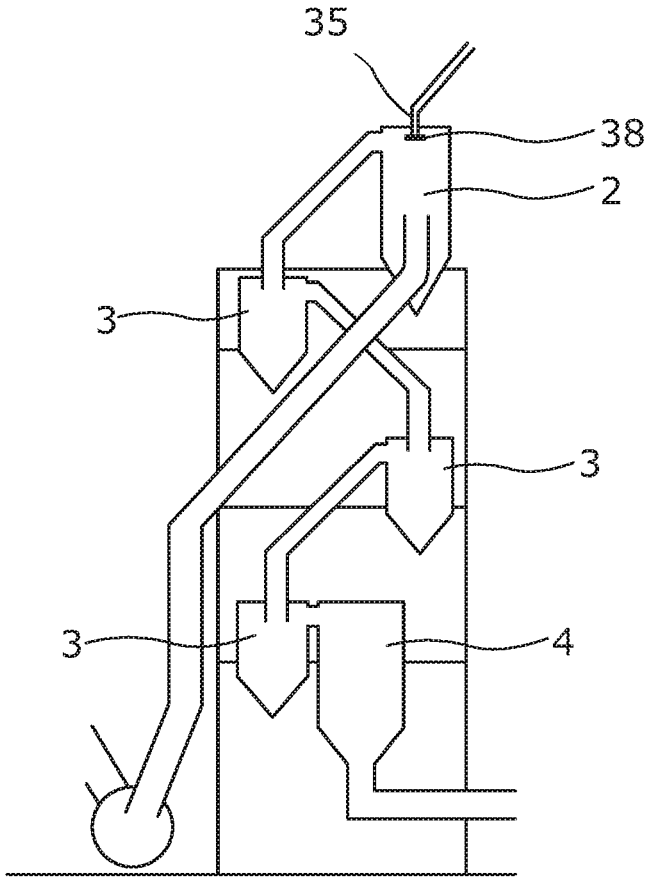
FIG. 6*a* shows a cross-sectional view of a multi-stage cement calcining plant suspension preheater of the invention.

FIG. 6*a* shows a cross-sectional view of a multi-stage cement calcining plant suspension preheater of the invention wherein the material feed inlet 35 comprises means for spreading the material feed 38 in a tangential and or radial direction.

Figure 6B:
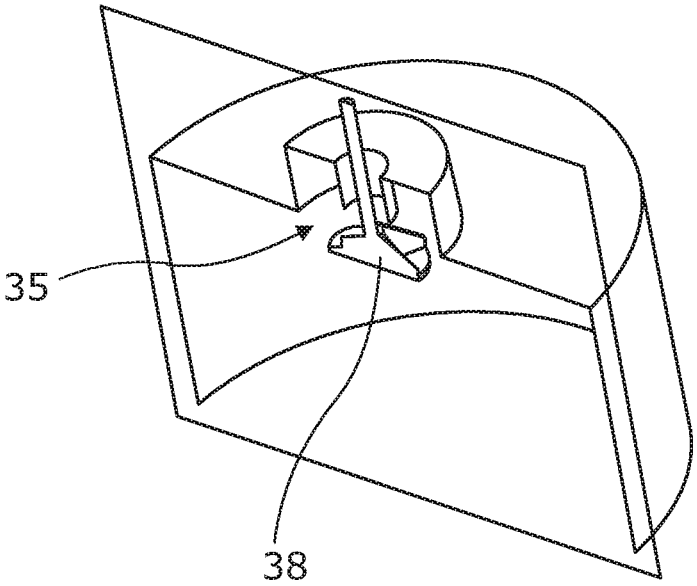
FIG. 6*b* shows a magnified view of an embodiment of a material feed inlet of a top separator of a multi-stage cement calcining plant suspension preheater of the invention.

FIG. 6*b* shows a magnified view of an embodiment of a material feed inlet comprising means for spreading the material feed 38 in a tangential and or radial direction in a tangential direction.

Figure 7:
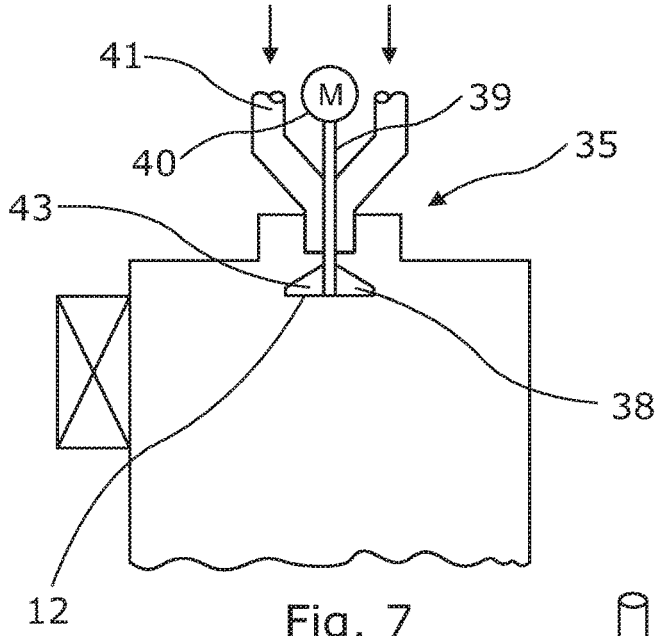
FIG. 7 shows a cross-sectional view of an embodiment of a material feed inlet of a top separator of a multi-stage cement calcining plant suspension preheater of the invention.
Figure 8A:
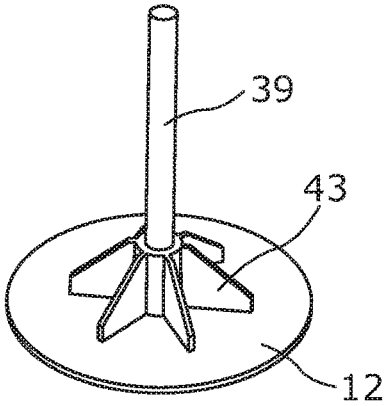
FIGS. 8*a-d* show four different embodiments of a rotating plate of the invention.
Figure 8B:
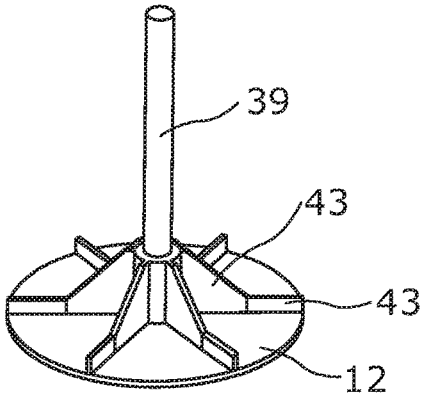
Figure 8C:
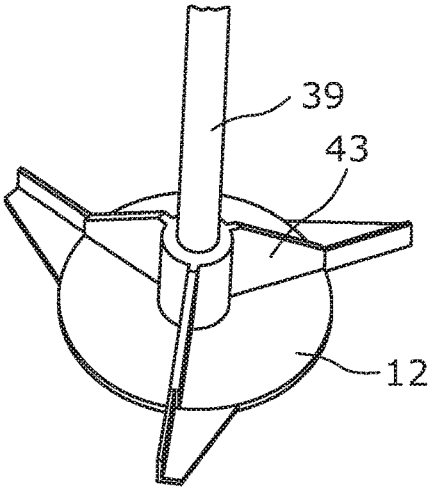
Figure 8D:
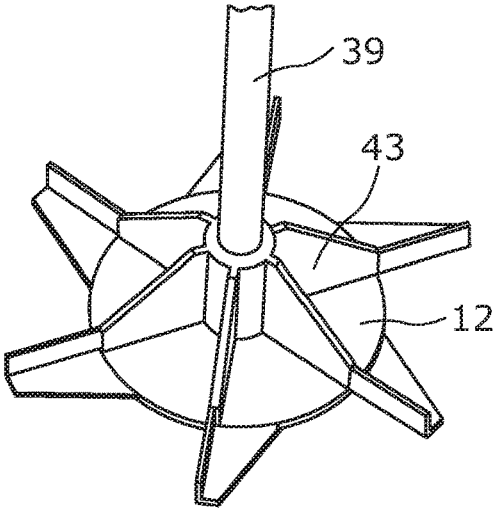

FIG. 7 shows a cross-sectional view of the same embodiment as in FIG. 6*b*, where the material feed inlet 35 comprises means for spreading the material feed 38 having an rotation axle 39 driven by a motor 40 and a material feed duct 41 for spilling the material feed onto a rotating plate 12 with shovel blades 43.

FIGS. 8*a-d* show four different embodiments of a rotating plate 12 with shovel blades 43 driven by a rotation axle.

Figure 9A:
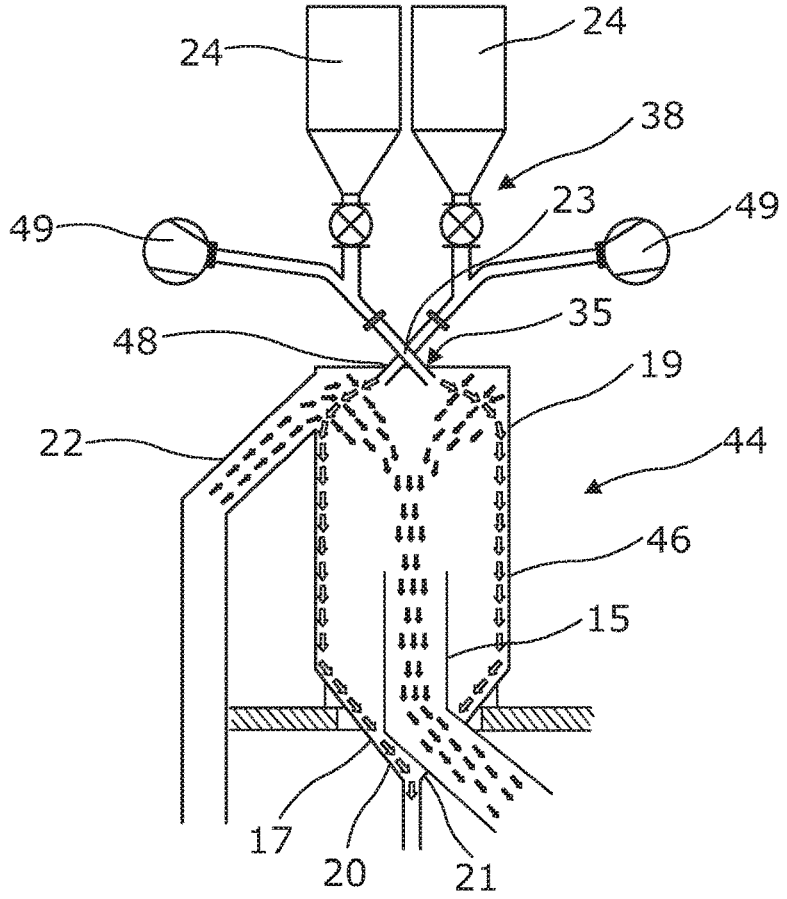
FIG. 9*a* shows a cross-sectional view of a top cyclone of the invention with airflow and material flow patterns.

FIG. 9*a* shows a cross-sectional view of a top cyclone of the invention with airflow and material flow patterns. As shown in FIG. 9*a* the top separator 44 comprises a tangential inlet 22 in the upper part of the separator housing, a top separator central tube 15 entering the separator housing 46 in the lower part 17 of the top separator housing 46, and wherein the top separator 44 comprises a material feed inlet 35 arranged in a central part 48 of an upper part 49 of the top separator housing 46. The material exits the top separator 44 through an outlet in a lowermost end 21 of the conical lower part 20. As illustrated the airflow enters the cyclone in the periphery of the upper part 19 of the top separator and exits the cyclone through the central tube extending with a free end axially into the separator housing in the substantially conical lower part 20 of the top separator, whereas the flow pattern of the material feed according to the invention enters the top separator from the centrally arranged material feed inlet 35 and is directed towards the periphery of the separator by centrifugal forces. Therefore the air and material is mixed in counter-current flow increasing the heat exchange significantly. To adjust the speed and direction of the material feed the material feed inlet 35 may comprise means for spreading the material feed 38 in a tangential and/or radial direction of the separator housing 46 of the top separator 44 directing the material feed in a direction from the centrally arranged inlet towards the periphery of the housing of the top separator 44. The means for spreading the material feed 38 in FIG. 9*a* comprises two tubes 23 connected to a material feed container 24 and further connected to a valve 49 for allowing pressurized air to enter the tubes 23 and speed up the material entering the top separator 44.

Figure 9B:
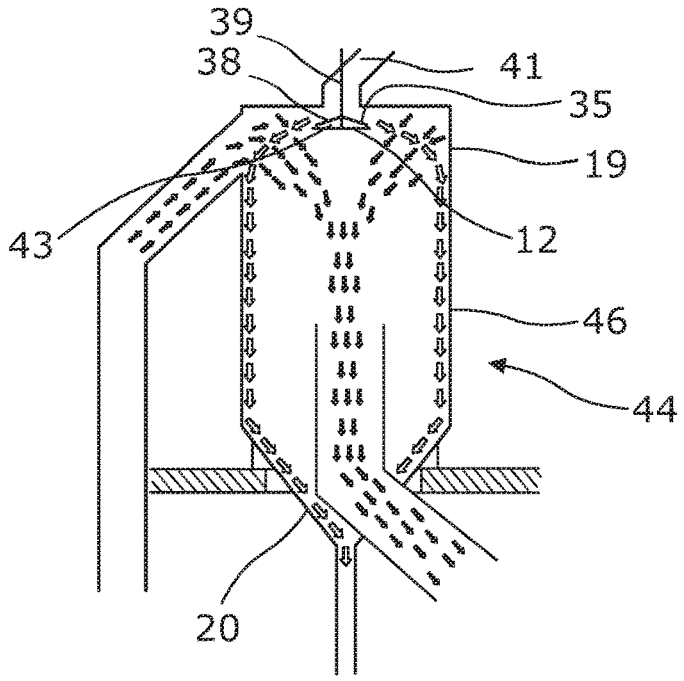
FIG. 9*b* shows a cross-sectional view of a top cyclone of the invention with airflow and material flow patterns.

In FIG. 9*b* the means for spreading the material feed 38 comprises a rotation axle 39 driven and a material feed duct 41 for spilling the material feed onto a rotating plate 12 with shovel blades 43 shows a cross-sectional view of a top cyclone of the invention with airflow and material flow patterns. As illustrated also in FIG. 9*b* the airflow enters the cyclone in the periphery of the upper part 19 of the top separator and exits the cyclone through the central tube extending with a free end axially into the separator housing in the substantially conical lower part 20 of the top separator, whereas the flow pattern of the material feed according to the invention enters the top separator from the centrally arranged material feed inlet 35 and is directed towards the periphery of the separator by centrifugal forces. Therefore the air and material is mixed in counter-current flow increasing the heat exchange significantly. To adjust the speed and direction of the material feed the material feed inlet 35 may comprise means for spreading the material feed 38 in a tangential and/or radial direction of the separator housing 46 of the top separator 14 directing the material feed in a direction from the centrally arranged inlet towards the periphery of the housing of the top separator 44.

Figure 10A:
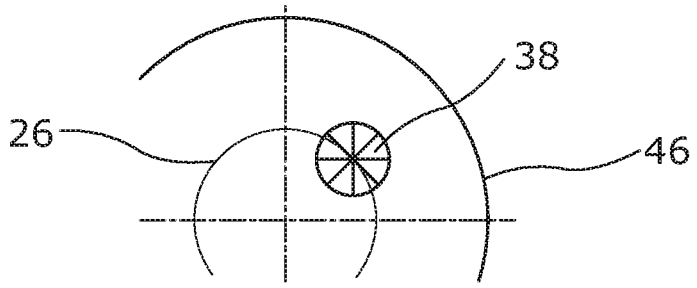
FIGS. 10*a-c* show four different arrangements of means for spreading the material feed in a cyclone.
Figure 10B:
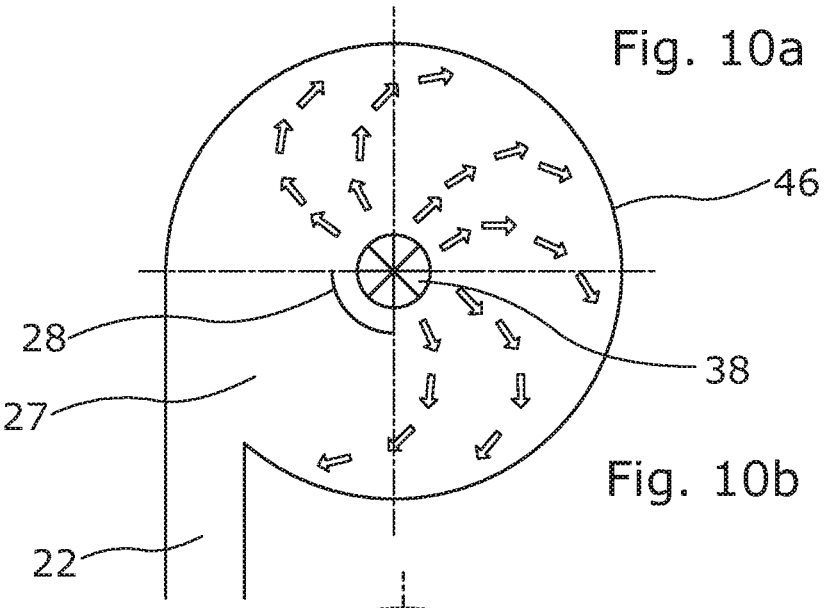
Figure 10C:
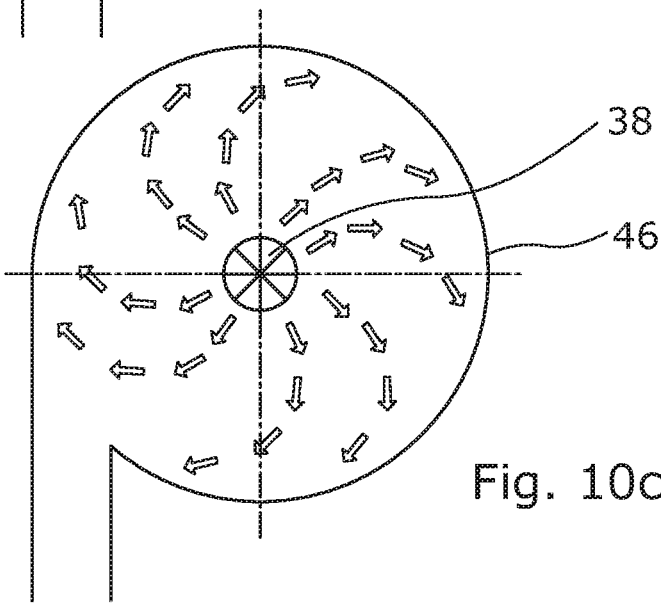

FIGS. 10*a-c* show three different arrangements of means for spreading the material feed 38 in a separator. FIG. 10*a* shows the means for spreading the material feed 38 arranged partially outside a central part 26 of the separator housing 46. This is unwanted since it will create an inhomogeneous distribution of material in the separator. As shown in FIG. 10*b*, the means for spreading the material feed 38 must be arranged in a central part of the separator housing to provide a homogeneous distribution of the material in the separator housing the material feed inlet 35 is to be placed in a central part. If the airstream entering the separator housing 46 through the tangential inlet 22 forces the material towards the periphery of the separator housing 46 too quickly to provide optimal heat exchange, an inlet zone 27 between the means for spreading the material feed 38 and the tangential inlet 22 may comprise an inlet shield 28. Placing an inlet shield 28 in the inlet zone 27 is more advantageous than arranging the means for spreading the material feed 38 away from the central part 26 of the separator housing 46. As shown in FIG. 10*c* the means for spreading the material feed 38 is optimally placed in the central part of the cylindrical part of the separator housing 46.

Figure 11A:
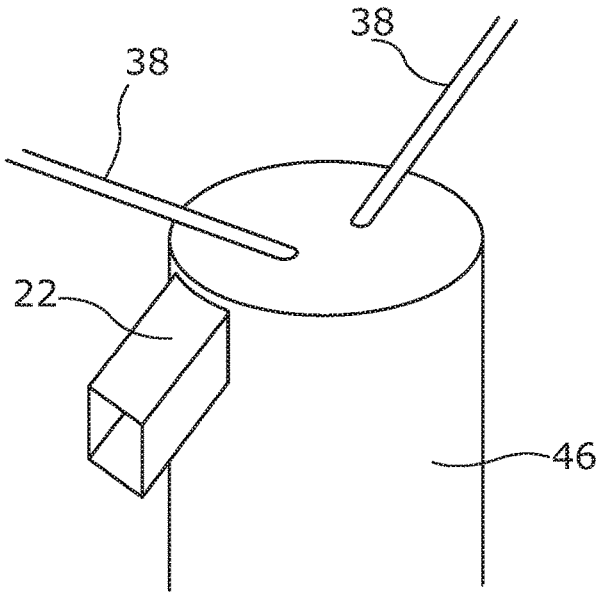
FIG. 11*a* shows a perspective view of an embodiment of the means for spreading the material feed in a cyclone comprising two tubes.
Figure 11B:
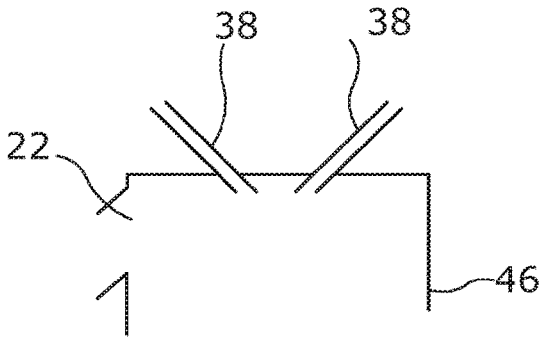
FIG. 11*b* shows a cross-sectional view of an embodiment of the means for spreading the material feed in a cyclone comprising two tubes.
Figure 11C:
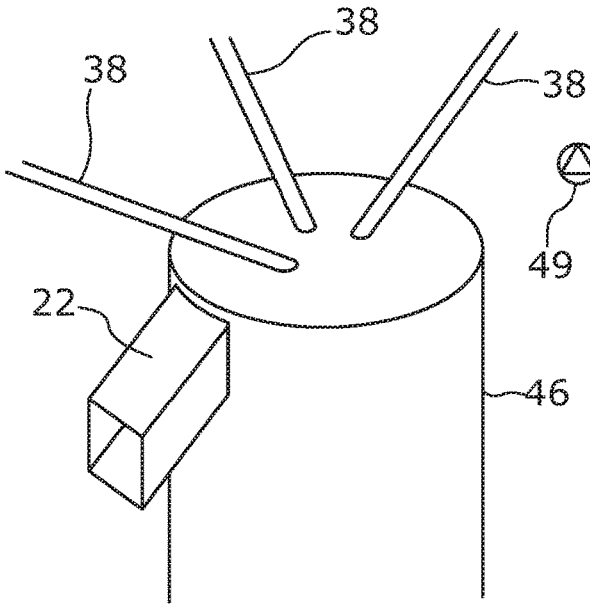
FIG. 11*c* shows a perspective view of an embodiment of the means for spreading the material feed in a cyclone comprising three tubes.

FIG. 11*a* shows a perspective view of an embodiment of the means for spreading the material feed 38 in a cyclone comprising two tubes entering the separator housing 46 in the central part of the upper part. FIG. 11*b* shows a cross-sectional view of an embodiment of the means for spreading the material feed 38 in a cyclone comprising two tubes entering the separator housing 46 in the central part of the upper part. FIG. 11*c* shows a perspective view of an embodiment of the means for spreading the material feed in a cyclone comprising three tubes entering the separator housing 46 in the central part of the upper part.

Figure 11D:
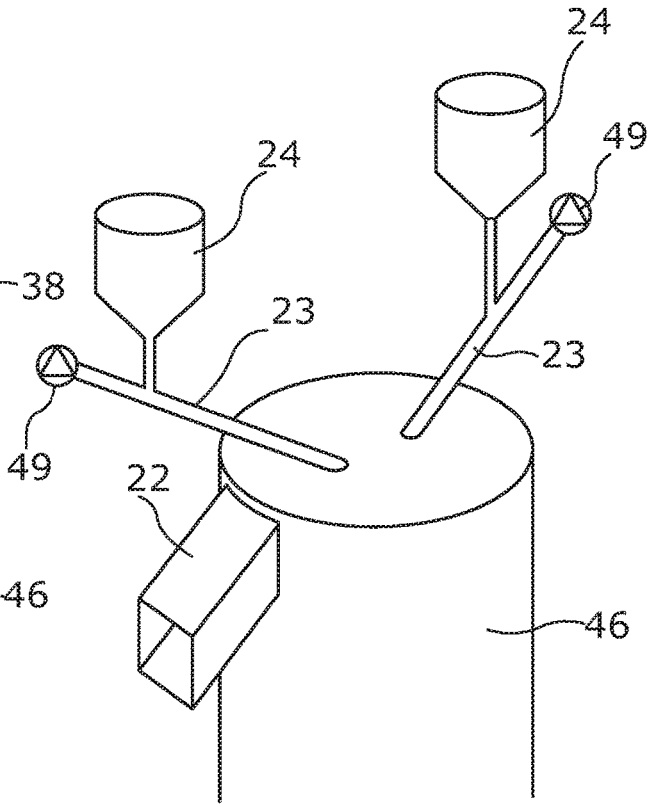
FIG. 11*d* shows a perspective view of an embodiment of a top cyclone comprising means for spreading the material feed comprising two tubes and means for accelerating the material feed by introducing pressurised air through a valve.

FIG. 11*d* shows a perspective view of an embodiment of a top cyclone comprising means for spreading the material feed 38 comprising two tubes 23 and means for accelerating the material feed by introducing pressurised air through a valve 49 to accelerate material conveyed from a material feed container 24.

Figure 12:
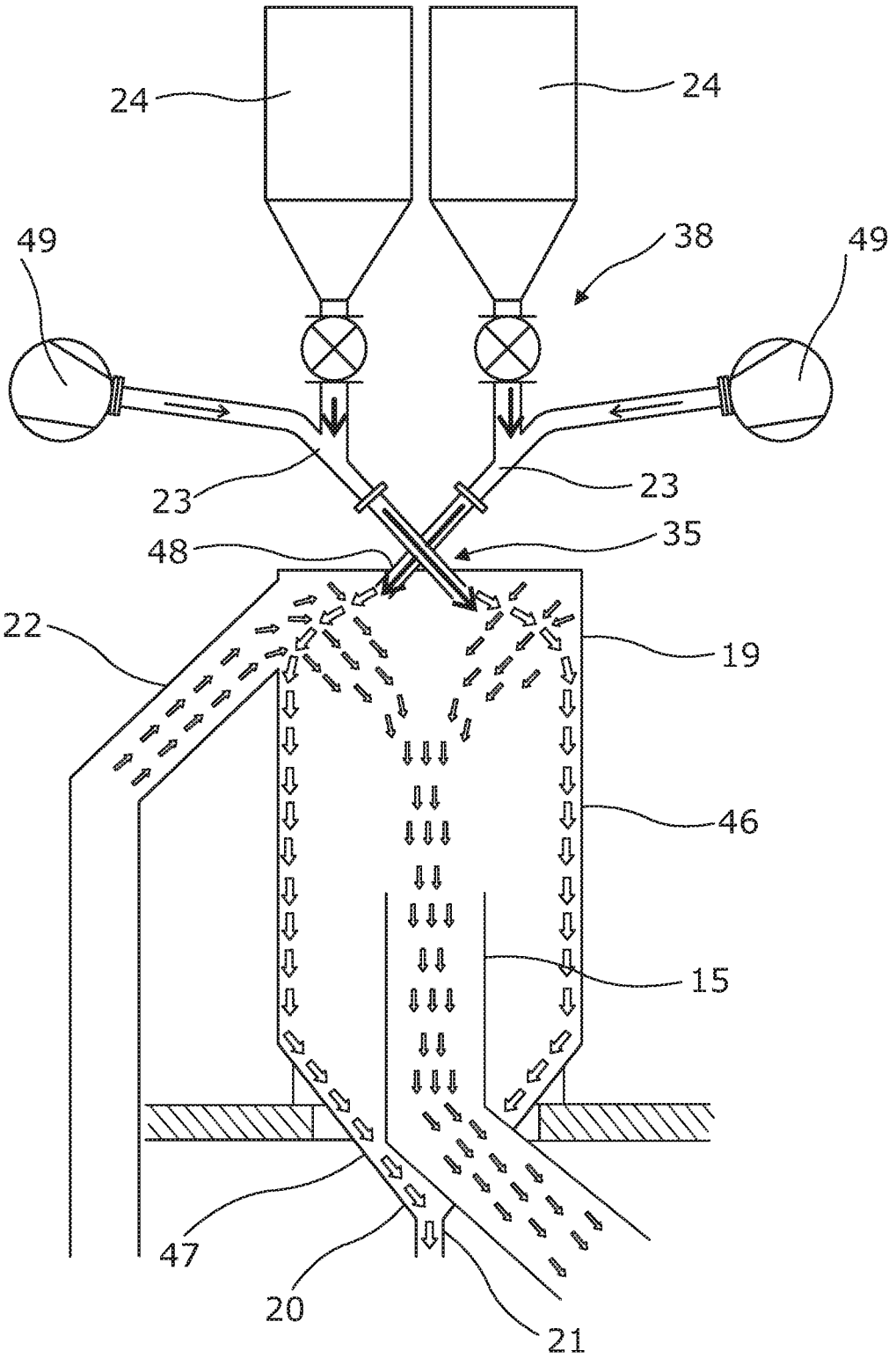
FIG. 12 shows a cross-sectional perspective view with flow patterns of an embodiment of a top cyclone comprising the means for spreading the material feed comprising two tubes and means for accelerating the material feed by introducing pressurised air through a valve.

FIG. 12 shows a cross-sectional view of a top cyclone of the invention with airflow and material flow patterns. As shown in FIG. 12 the top separator 44 comprises a tangential inlet 22 in the upper part of the separator housing, a top separator central tube 15 entering the separator housing 46 in the lower part 47 of the top separator housing 46, and wherein the top separator 44 comprises a material feed inlet 35 arranged in a central part 48 of an upper part 19 of the top separator housing 46. The material exits the top separator 44 through an outlet in a lowermost end 21 of the conical lower part 20.

As illustrated the airflow enters the cyclone in the periphery of the upper part 19 of the top separator and exits the cyclone through the central tube extending with a free end axially into the separator housing in the substantially conical lower part 20 of the top separator, whereas the flow pattern of the material feed according to the invention enters the top separator from the centrally arranged material feed inlet 35 and is directed towards the periphery of the separator by centrifugal forces. Therefore the air and material is mixed in counter-current flow increasing the heat exchange significantly. To adjust the speed and direction of the material feed the material feed inlet 35 may comprise means for spreading the material feed 38 in a tangential and/or radial direction of the separator housing 46 of the top separator 44 directing the material feed in a direction from the centrally arranged inlet towards the periphery of the housing of the top separator 44. The means for spreading the material feed 38 in FIG. 12 comprises two tubes 23 connected to a material feed container 24 and further connected to a valve 49 for allowing pressurized air to enter the tubes 23 and speed up the material entering the top separator 44.

Figure 13A:
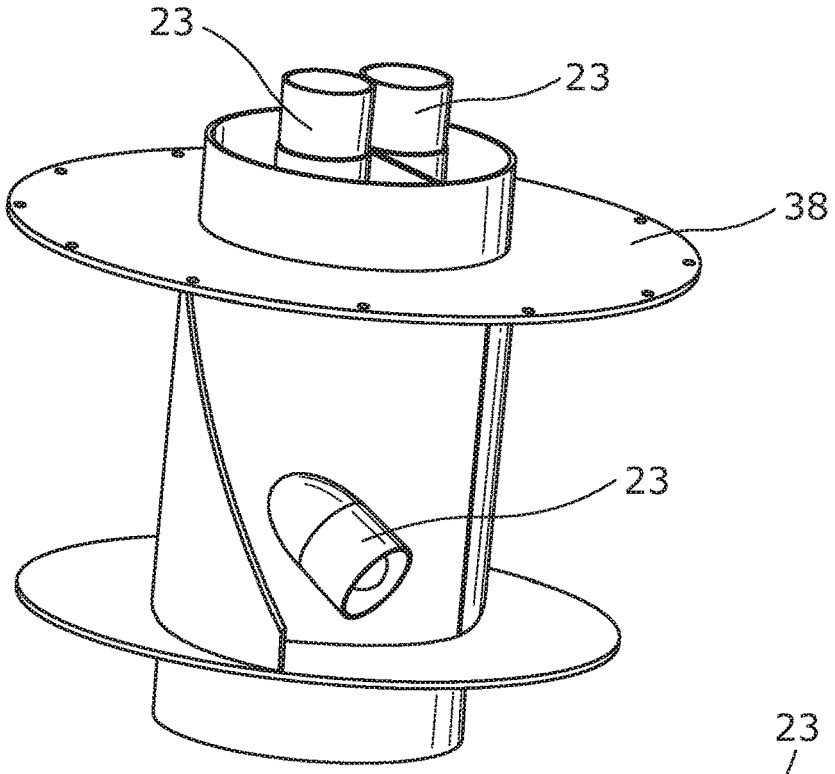
FIG. 13*a* shows a perspective view of an embodiment of a means for spreading the material feed comprising two tubes angled in a radial and tangential direction for introducing the material feed in the cyclone with a radial and tangential velocity component.
Figure 13B:
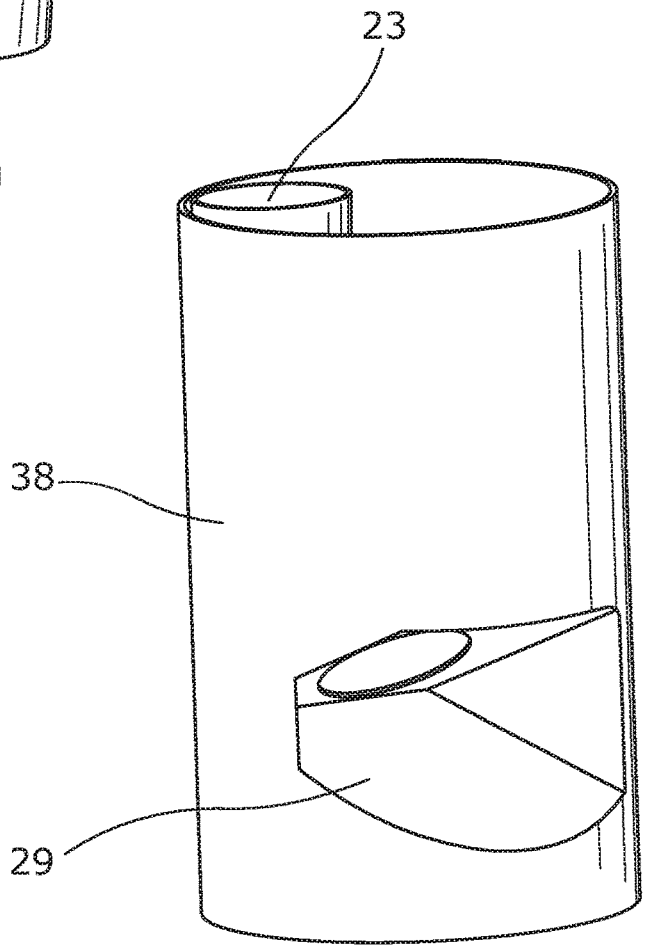
FIG. 13*b* shows a perspective view of an embodiment of a means for spreading the material feed comprising one tube and a splash plate angled in a radial and tangential direction for introducing the material feed in the cyclone with a radial and tangential velocity component.

FIG. 13*a* shows a perspective view of an embodiment of a means for spreading the material feed comprising two tubes 23 angled in a radial and tangential direction for introducing the material feed in the cyclone with a radial and tangential velocity component. FIG. 13*b* shows a perspective view of an embodiment of a means for spreading the material feed 8 comprising one tube 23 and a splash plate 29 angled in a radial and tangential direction for introducing the material feed in the cyclone with a radial and tangential velocity component.

Figure 14:
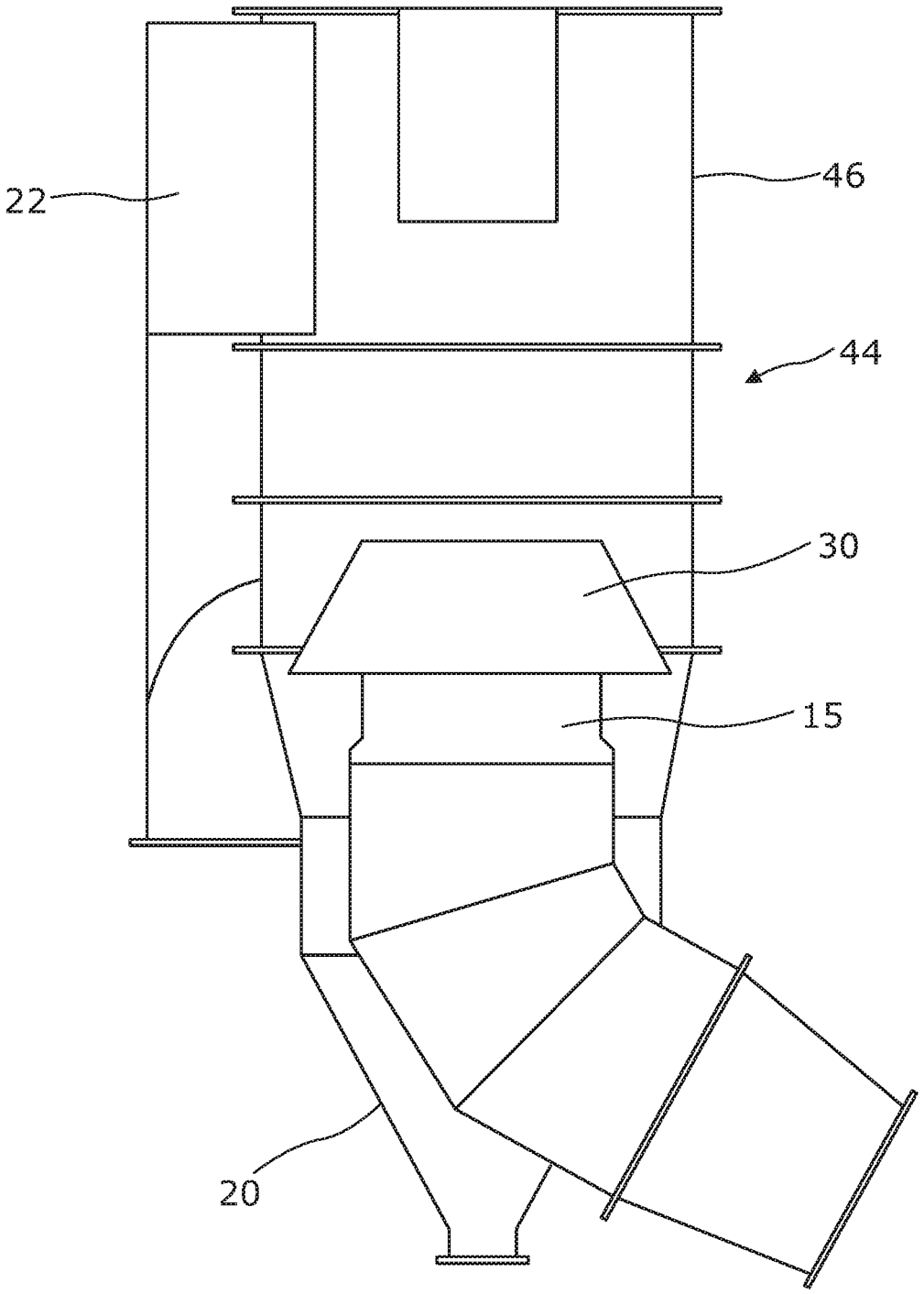
FIG. 14 shows a cross-sectional perspective view of a top cycle with flow restriction means on the outlet of a top cyclone.

FIG. 14 shows a cross-sectional perspective view of a top cycle with flow restriction means 30 on the top separator central tube 45 of a top separator 44.

The invention claimed is:

1. A multi-stage cement calcining plant suspension preheater comprising:

a plurality of stages each of which has a separator for separating raw cement meal from a gas in which the meal is suspended and wherein the separators of the plurality of stages are serially connected and in series with a calcining combustor, the plurality of stages comprising a top separator arranged at the uppermost stage of the preheater and a plurality of bottom separators arranged at the lowermost stages of the preheater, the top separator comprising:

a top separator housing comprising a substantially cylindrical top separator upper part and a substantially conical top separator lower part, a top separator tangential inlet in the top separator upper part of the top separator housing for introducing an un-separated stream of gas and raw cement meal in suspension, a top separator outlet in a lowermost end of the conical top separator lower part for discharging a first fraction of coarse cement raw meal material, a top separator central tube extending with a free end axially into the top separator housing for diverting a second fraction of fine cement raw meal material and gas, the bottom separators comprising:

a bottom separator housing comprising a substantially cylindrical bottom separator upper part and a substantially conical bottom separator lower part, a bottom separator tangential inlet in the bottom separator upper part of the bottom separator housing for introducing an unseparated stream of gas and raw cement meal in suspension, a bottom separator outlet in a lowermost end of the conical bottom separator lower part for discharging a first fraction of coarse cement raw meal material, a bottom separator central tube extending with a free end axially into the bottom separator housing for diverting a second fraction of fine cement raw meal material and gas, wherein the top separator central tube enters the top separator housing in the lower part of the top separator housing, and wherein the central tubes of the bottom separators enter the bottom separator housing in the upper part of the bottom separator housing.

2. The preheater of claim 1, wherein the top separator comprises a top separator suspension having a receiving opening for receiving and supporting the top separator, wherein a receiving opening diameter of the receiving opening is smaller than a top separator upper part diameter of the top separator upper part and wherein the top separator is suspended by the top separator suspension engaging the top separator lower part.

3. The preheater of claim 1, wherein a ratio between an upper part diameter $D_{CYL}$ of the top separator upper part and a central tube diameter $D_{CT}$ of the top separator central tube is between $1.8<D_{CYL}/D_{CT}<3$.

4. The preheater of claim 3, wherein the upper part diameter of the top separator upper part is larger than a upper part diameter of the bottom separator upper part.

5. The preheater of claim 1, wherein the top separator comprises a material feed inlet arranged in a central part of the upper part of the top separator housing.

6. The preheater of claim 5, wherein the material feed inlet is arranged co-axially with a longitudinal center axis of the top separator housing.

7. The preheater of claim 5, wherein the material feed inlet comprises means for spreading material feed in a tangential direction of the top separator housing directing the material feed in a direction from the material feed inlet towards the periphery of the top separator housing such that the material feed exiting the material inlet has a tangential velocity component in a tangential direction of the top separator housing.

8. The preheater of claim 7, wherein, the tangential direction is co-current with a direction of airflow in the top separator.

9. The preheater of claim 5, wherein the material feed inlet comprises means for spreading material feed in a radial direction of the top separator housing directing the material feed in a direction from the material feed inlet towards the periphery of the top separator housing such that the material feed exiting the material inlet has a radial velocity component in a radial direction of the top separator housing.

10. The preheater according to claim 7, wherein the means for spreading the material feed in the tangential direction comprises an exit tube directed in the tangential direction.

11. The preheater according to claim 7, wherein the means for spreading the material feed in the tangential direction comprises a splash plate angled in the tangential direction.

12. The preheater according to claim 7, wherein the means for spreading the material feed in the tangential direction comprises material accelerating means such as pressurized air or mechanical conveyor means.

13. The preheater according to claim 7, wherein the means for spreading the material feed in the tangential direction comprises a rotating plate for accelerating the material after entry into the top separator.

14. The preheater of claim 13, wherein the rotating plate comprises one or more substantially vertical shovel blades for forcing the material in the direction of rotation of the rotating plate.

15. The preheater of claim 14, wherein the shovel blades extend from the center of the rotating plate to the periphery of the rotating plate in a substantially radial direction.

16. The preheater of claim 14, wherein the shovel blades are gradually decreasing in height from the center of the rotating plate towards the periphery of the rotating plate.

17. The preheater according to claim 9, wherein the means for spreading the material feed in the radial direction comprises an exit tube directed in the radial direction.

18. The preheater according to claim 9, wherein the means for spreading the material feed in the radial direction comprises a splash plate angled in the radial direction.

19. The preheater according to claim 9, wherein the means for spreading the material feed in the radial direction comprises material accelerating means such as pressurized air or mechanical conveyor means.

20. The preheater according to claim 9, wherein the means for spreading the material feed in the radial direction comprises a rotating plate for accelerating the material after entry into the top separator.

* * * * *